US012336651B1

(12) United States Patent
Stephen

(10) Patent No.: US 12,336,651 B1
(45) Date of Patent: Jun. 24, 2025

(54) METHOD AND APPARATUS FOR FOOT PILLOW

(71) Applicant: Elouise Yvonne Stephen, Anthem, AZ (US)

(72) Inventor: Elouise Yvonne Stephen, Anthem, AZ (US)

( * ) Notice: Subject to any disclaimer, the term of this patent is extended or adjusted under 35 U.S.C. 154(b) by 0 days.

(21) Appl. No.: 18/907,172

(22) Filed: Oct. 4, 2024

(51) Int. Cl.
*A47G 9/10* (2006.01)
*A47C 16/02* (2006.01)

(52) U.S. Cl.
CPC ..... *A47G 9/1045* (2013.01); *A47C 16/02* (2013.01)

(58) Field of Classification Search
CPC ..... A47G 9/10; A47G 9/1009; A47G 9/1027; A47G 9/1036; A47G 9/1045; A47G 9/1054; A47G 9/1063; A47G 9/1072; A47G 9/1081; A47G 9/109; A47G 2009/1018; A47C 16/00; A47C 16/06
See application file for complete search history.

(56) References Cited

U.S. PATENT DOCUMENTS 3,974,532 A * 8/1976 Ecchuya ..... A47G 9/10 5/636
4,028,754 A * 6/1977 Eary, Sr. ..... A47C 20/026 5/636
5,226,245 A * 7/1993 Lamont ..... A61F 5/0195 128/892
6,023,798 A * 2/2000 Hui ..... A47G 9/10 5/636
6,499,166 B1 * 12/2002 Jones ..... A47C 20/048 5/715
7,055,197 B1 * 6/2006 Fathali ..... A47G 9/10 5/636
D657,746 S * 4/2012 Utudjian ..... D13/154
8,572,780 B1 * 11/2013 Watters ..... A47G 9/1054 5/636
10,694,873 B2 * 6/2020 McEntee ..... A47G 9/1081
2002/0138908 A1 * 10/2002 Wang ..... A47G 9/10 5/636
2003/0061659 A1 * 4/2003 Dunlap ..... A47G 9/066 5/485
2012/0054966 A1 * 3/2012 Bacon ..... A47G 9/1081 5/636
2013/0025052 A1 * 1/2013 Briody ..... A47G 9/10 5/485
2013/0181497 A1 * 7/2013 Gurall ..... A47C 16/02 297/423.1
2013/0263377 A1 * 10/2013 Wootten, Jr. ..... A47C 27/15 5/640
2016/0113408 A1 * 4/2016 Shaffer ..... A47G 9/10 5/648

(Continued)

*Primary Examiner* — George Sun
(74) *Attorney, Agent, or Firm* — Inspired Idea Solutions Law Firm

(57) ABSTRACT

A foldable pillow is provided. The pillow may have first, second, and third sections. The first and third sections may be formed by a single pillow. The second section may be formed by a plurality of pillows configured to optimize folding of the foldable pillow. The first, second, and third sections may be arranged sequentially. A user's foot may be placed on the first section. The third section may be folded over and placed on top of the first section (such as over the user's foot). The second section may enable a cavity to be formed to house the user's foot and provide comfort, support, insulation, and protection.

18 Claims, 4 Drawing Sheets

(56) References Cited

U.S. PATENT DOCUMENTS

| | | | | |
|---|---|---|---|---|
| 2018/0049550 | A1* | 2/2018 | Levy | A47G 9/1027 |
| 2018/0153319 | A1* | 6/2018 | Artis | A47C 17/045 |
| 2018/0184820 | A1* | 7/2018 | Johnson | A47G 9/109 |
| 2019/0167020 | A1* | 6/2019 | Bice | A47C 7/46 |
| 2020/0154912 | A1* | 5/2020 | Del Balso | A47G 9/10 |
| 2022/0225799 | A1* | 7/2022 | Chen | A47G 9/1045 |
| 2022/0265070 | A1* | 8/2022 | Usle | A47G 9/10 |

* cited by examiner

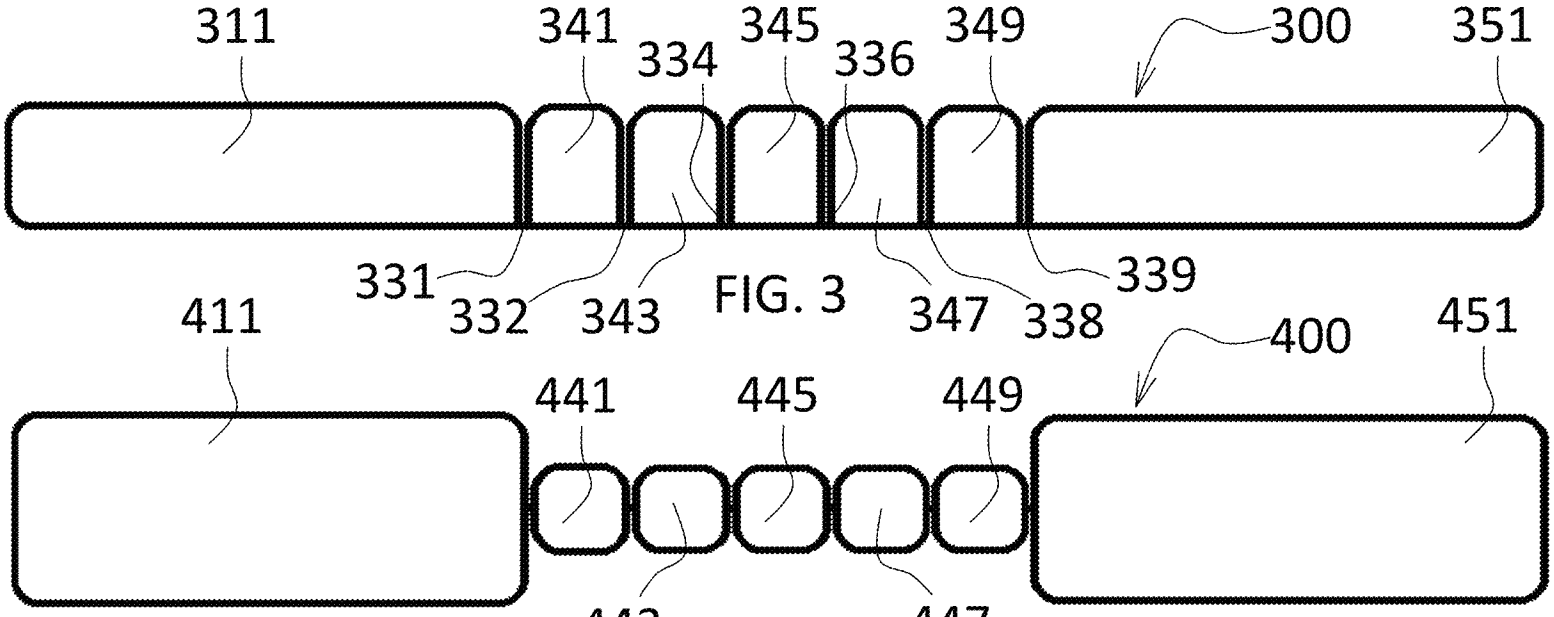
FIG. 3
FIG. 4
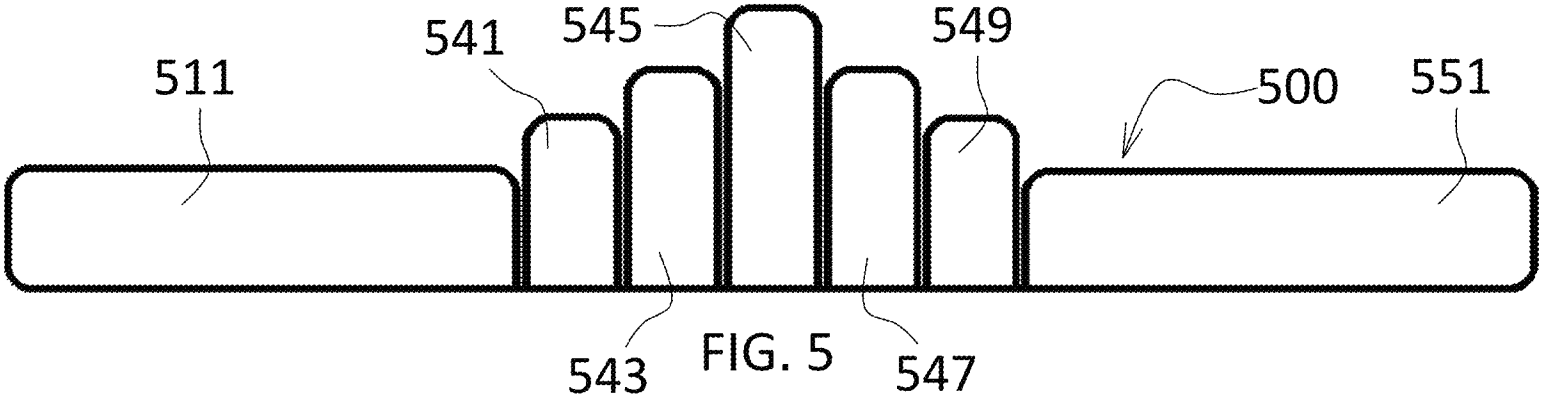
FIG. 5

METHOD AND APPARATUS FOR FOOT PILLOW

FIELD

The present disclosure generally relates to pillows, and more particularly to pillows used to support the foot.

BACKGROUND

Pillows have a long and distinguished history, reflecting changes in culture, technology, and comfort preferences over thousands of years. The earliest recorded use of pillows was in ancient Mesopotamia, where they were often made of stone or wood and were more about providing head support rather than comfort. Much later, the Chinese used wood, bamboo, and ceramics which may have been for perceived improvements to health, beauty, or alignment of one's chi. Much later, the Greeks and Romans used pillows made of feathers and reeds stuffed in fabric. This design has persisted until today, but has become more readily available to the common person, rather than being a luxury of the most elite in society.

In the modern era, advancements in technology have brought about the use of various new materials, including synthetic fibers, latex, foam, gel, and so forth. Pillows have also become more commonly used for supporting more than just the head. However, pillows still have a number of drawbacks, such as causing adverse allergic reactions, requiring maintenance, difficulty in cleaning, exacerbating health conditions by providing inadequate support, high cost, and so forth.

Therefore, it would be desirable to optimize pillow construction to improve comfort, usability, maintenance, and other performance characteristics of pillows based on the intended use of the pillow.

SUMMARY

A pillow comprising a first section formed by a pillow, a second section formed by a plurality of pillows, and a third section formed by a pillow, wherein the first, second, and third sections extend along a longitudinal direction, and wherein the largest dimension of the plurality of pillows extends orthogonally to the longitudinal direction.

A pillow comprising a first section formed by a pillow, a second section coupled to the first section, the second section formed by a plurality of pillows coupled together, and a third section coupled to the second section opposite the first section along a longitudinal direction, the third section formed by a pillow, wherein the largest dimension of the plurality of pillows extends orthogonally to the longitudinal direction.

A method of folding a pillow around a foot of a patient, the pillow having a first section formed by a pillow, a second section formed by a plurality of pillows, and a third section formed by a pillow, wherein the first, second, and third sections extend sequentially in a longitudinal direction, and wherein the largest dimension of the plurality of pillows extends orthogonally to the longitudinal direction, the method comprising placing the foot on the first section, folding the second section and third section until the third section is located above the first section, and enclosing the foot between the first, second, and third sections by sealing the first and third sections around a leg of the patient.

BRIEF DESCRIPTION OF THE DRAWINGS

Various aspects and advantages will become apparent upon review of the following detailed description and upon reference to the drawings in which:

FIG. 3 illustrates a front view of a pillow;
FIG. 4 illustrates a front view of a pillow;
FIG. 5 illustrates a front view of a pillow.

DETAILED DESCRIPTION

The following disclosure includes a method and apparatus for a pillow configured to receive and/or enclose a user's foot (e.g., a patient). The pillow may have a first section, a second section, and a third section. The first section may be formed by a pillow. The user's foot may be placed on the first section. A third section formed by a pillow may be placed over the top of the user's foot. A second section formed by a plurality of pillows may be coupled between the first section and the third section. The second section may optimize folding of the pillow to provide room, comfort, support, insulation, and protection for the user's foot. The third section may seal against the first section (e.g., enclosing around the user's foot), and may hug an ankle and/or leg of the user.

Figure 1:
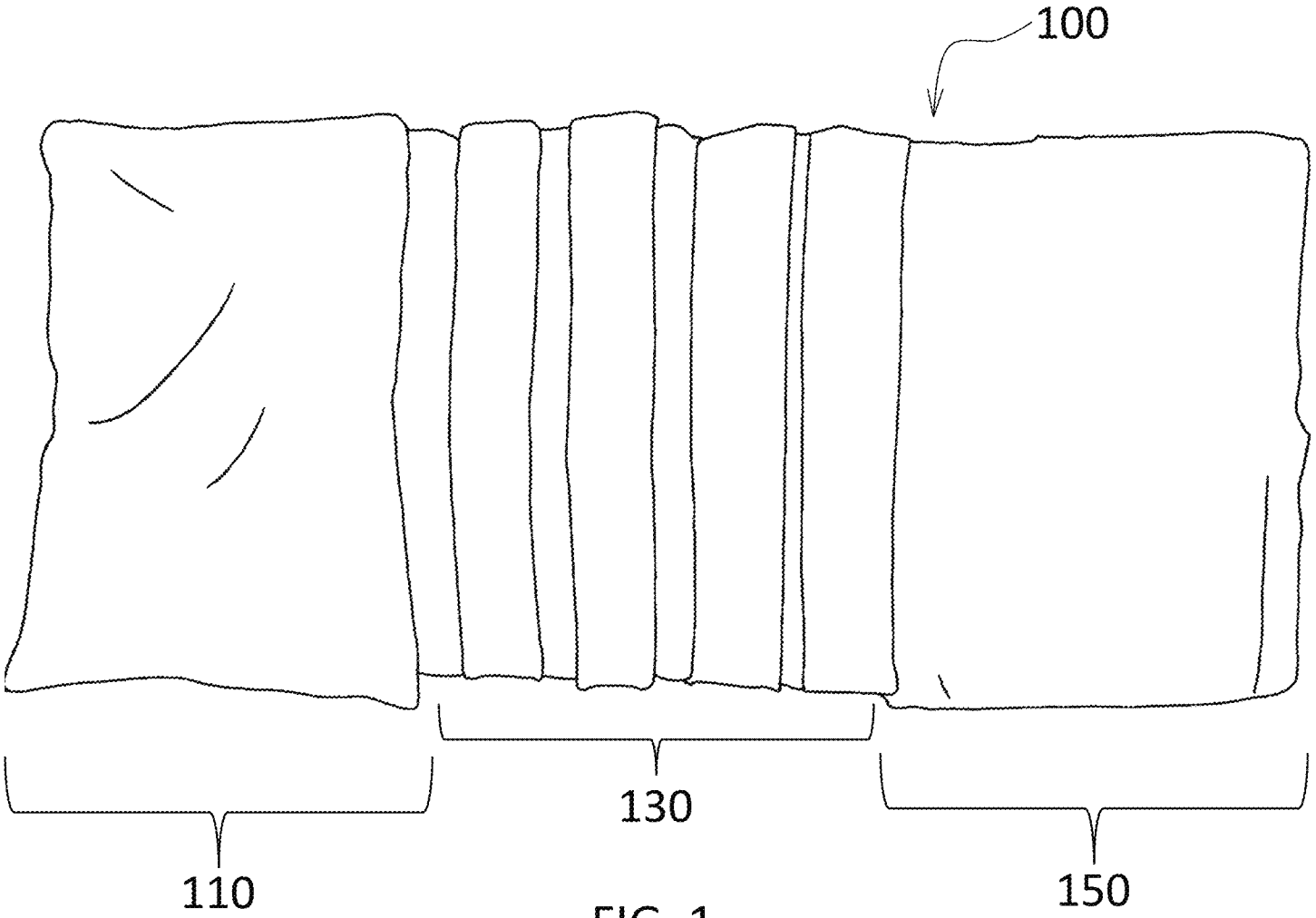
FIG. 1 illustrates a top view of a photograph of a pillow.

FIG. 1 illustrates a pillow 100 having a plurality of sections configured to conform to a foot. A first section 110, a second section 130, and a third section 150 may be arranged in a longitudinal direction (e.g., along a line, or one after another). First section 110 and third section 150 may be identical (e.g., as exemplified in FIG. 1), or may have different design features. The dimensions, material selection, and/or construction of first section 110 and third section 150 may be identical, similar, or different, such as to accommodate feet having different sizes, shapes, or other features (e.g., man-made additions such as casts, braces, slings, boots, and so forth).

Second section 130 may be identical, or may have different design features as first section 110 and/or third section 150. The dimensions, material selection, and/or construction of second section 130 may be identical, similar, or different, such as to accommodate feet having different sizes, shapes, or other features. Second section 130 may be configured to optimize folding of pillow 100 around a user's foot. Thus, pillow 100 may be capable of adequately providing support to a user's foot, protecting the user's foot from various directions, insulating the user's foot, and so forth.

During use, the foot of a user of pillow 100 may be placed on either first section 110 or third section 150 (e.g., where such placement is interchangeable). The user's leg may extend from the foot in the longitudinal direction away from pillow 100, or at an angle to the longitudinal direction up to about ninety degrees from the longitudinal direction (give or take twenty degrees). In general, the foot may be extending upward (e.g., vertically) away from the section upon which it is placed (e.g., away from either first section 110 or third section 150), or at an incline with respect to a vertical axis up to about ninety degrees from the vertical axis.

Second section 130 may be folded upward, and the remaining section may be folded over the top of the user's foot (e.g., over the top of the section under the user's foot). Where the user's foot was placed on first section 110, third section 150 may be folded over the top of the user's foot and/or first section 110. Where the user's foot was placed on third section 150, first section 110 may be folded over the top of the user's foot and/or third section 150. In either case, second section 130 may enable folding of pillow 100 around the user's foot. Second section 130 may extend along the bottom of the user's foot. Second section 130 may extend along the side of the user's foot. Second section may extend along the back of the user's foot.

Figure 2:
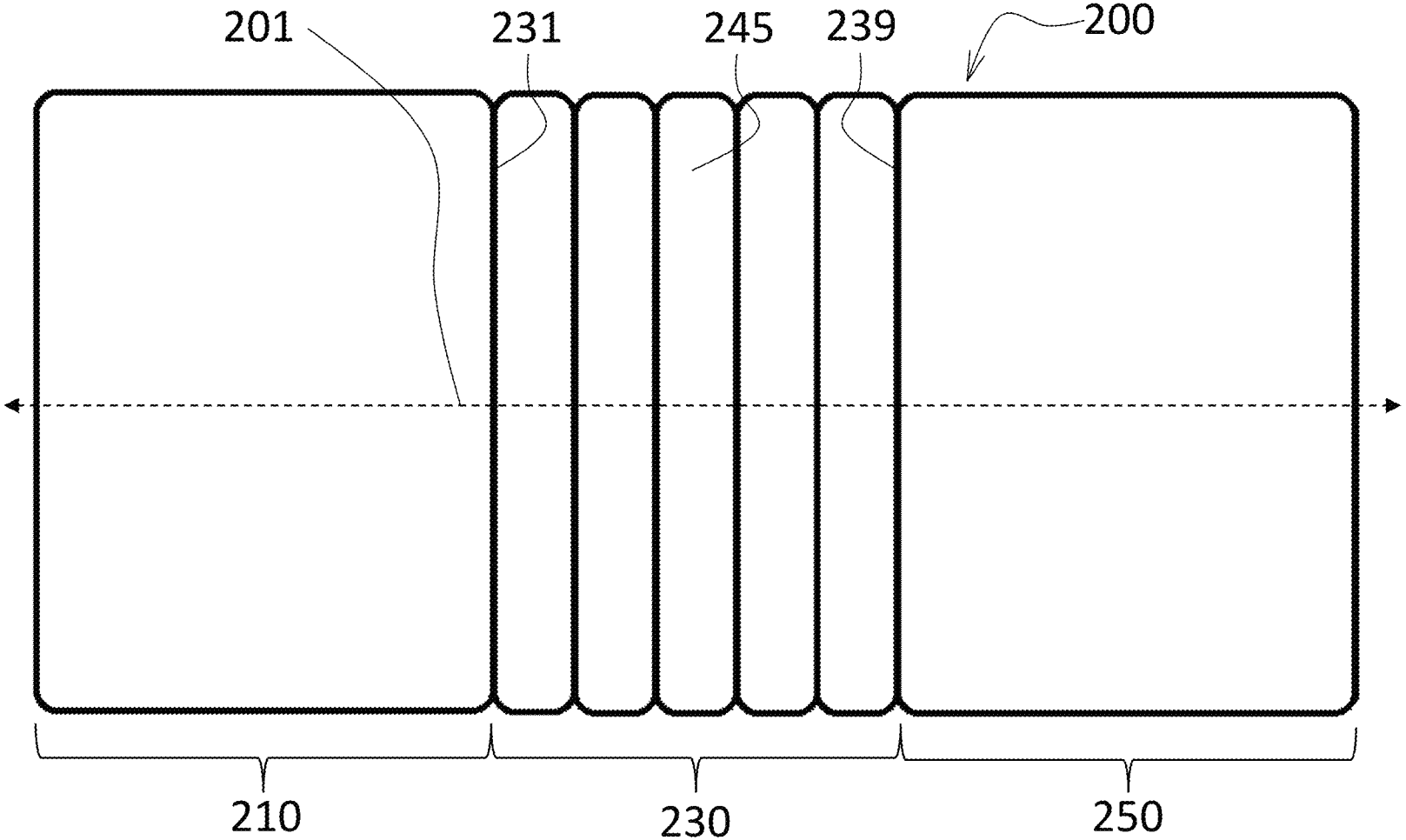
FIG. 2 illustrates a top view of a pillow.

FIG. 2 illustrates a pillow 200 having a plurality of sections configured to conform to a user's foot. A first section 210, a second section 230, and a third section 250 may be arranged (e.g., sequentially) along a longitudinal direction 201. First section 210 may be approximately similar to third section 250 in size, shape, and/or construction. Second section 230 may be positioned between first section 210 and third section 250. First section 210 and third section 250 may be positioned on opposing sides of second section 230.

First section 210 and third section 250 may each be in the form of a single pillow (e.g., having a pillow formed by a length extending in the longitudinal direction 201 and a width extending orthogonally to the longitudinal direction 201). Second section 230 may be in the form of a plurality of pillows 245 (e.g., 1, 2, 3, 4, 5, 6, 7, 8, or more pillows). The plurality of pillows 245 may be sized, shaped, and/or constructed similarly or differently than the pillows forming first section 210 and/or third section 250. The plurality of pillows 245 may be substantially shorter in the longitudinal direction 201 than the pillows forming first section 210 and/or third section 250 (e.g., the length of each of the plurality of pillows 245 may be less than the length of the pillows forming first section 210 and/or third section 250). The plurality of pillows 245 may be substantially similar in dimension in the orthogonal direction to the pillows forming first section 210 and/or third section 250 (e.g., the width of each of the plurality of pillows 245 may be similar to the width of the pillows forming first section 210 and/or third section 250).

Pillows situated adjacent to each other may be joined in any suitable manner, such as by weave, seam, bond, and so forth. First section 210 may be joined to second section 230 along a shared edge (e.g., seam 231). Second section 230 may be joined to third section 250 along a shared edge (e.g., seam 239). The plurality of pillows 245 of second section 230 may be joined along common edges (e.g., as further exemplified in FIGS. 3-5).

The length of second section 230 is exemplified as less than the lengths of first section 210 and third section 250, however, this disclosure contemplates the length of second section 230 as less than, equal to, or greater than the lengths of first section 210 and/or third section 250. The length of first section 210 is exemplified as equal to the length of third section 250, however, this disclosure contemplates the length of first section 210 as less than, equal to, or greater than the length of third section 250. Likewise, this disclosure contemplates widths of first section 210, second section 230, and third section 250 than may be less than, equal to, or greater than the other sections. Furthermore, this disclosure contemplates lengths and widths of each of the plurality of pillows 245 that may be similar to, or different from others of the plurality of pillows 245 and/or similar to, or different from the first section 210 and/or third section 250.

FIG. 3 illustrates a side view of a pillow 300 having a plurality of sections configured to wrap around a user's foot. A first section may include a single pillow 311. A second section may include a plurality of pillows (e.g., first pillow 341, second pillow 343, third pillow 345, fourth pillow 347, and fifth pillow 349). A third section may include a single pillow 351. Each section may be arranged sequentially.

Pillow 311 may be approximately similar to pillow 351 in size, shape, and/or construction. Pillow 311 and pillow 351 may have a length extending in the longitudinal direction and a height extending orthogonally to the longitudinal direction. The plurality of pillows of the second section may be different to pillow 311 and/or pillow 351. First pillow 341, second pillow 343, third pillow 345, fourth pillow 347, and fifth pillow 349 may each have a length extending in the longitudinal direction and a height extending orthogonally to the longitudinal direction. The height of pillow 311 may be equal to the height of pillow 351. The height of pillow 311 may be equal to the height of first pillow 341, second pillow 343, third pillow 345, fourth pillow 347, and/or fifth pillow 349. While the lengths of each of the plurality of pillows is exemplified as roughly identical, this disclosure contemplates the plurality of pillows have similar or different lengths.

Each pillow may be joined to the next adjacent pillow along a common edge (e.g., exemplified as a common point in FIG. 3). Pillow 311 may be joined to first pillow 341 at a first common edge 331. First pillow 341 may be joined to second pillow 343 at a second common edge 332. Second pillow 343 may be joined to third pillow 345 at a third common edge 334. Third pillow 345 may be joined to fourth pillow 347 at a fourth common edge 336. Fourth pillow 347 may be joined to fifth pillow 349 at a fifth common edge 338. Fifth pillow 349 may be joined to pillow 351 at a sixth common edge 339. While common edges 331, 332, 334, 336, 338, and 339 are exemplified at the bottom corners of the pillows, this disclosure contemplates common edges located at the bottom corners, top corners, middle, and at other locations along the height of the pillows.

FIG. 4 illustrates a side view of a pillow 400 having a plurality of sections configured to enclose around a user's foot. A first section may include a single pillow 411. A second section may include a plurality of pillows (e.g., first pillow 441, second pillow 443, third pillow 445, fourth pillow 447, and fifth pillow 449). A third section may include a single pillow 451. Each section may be arranged sequentially.

Pillow 411 and pillow 451 may have a length extending in the longitudinal direction and a height extending orthogonally to the longitudinal direction. The plurality of pillows of the second section may be different to pillow 411 and/or pillow 451. First pillow 441, second pillow 443, third pillow 445, fourth pillow 447, and fifth pillow 449 may each have a length extending in the longitudinal direction and a height extending orthogonally to the longitudinal direction. The height of pillow 411 may be equal to the height of pillow 451. The height of pillow 411 may be greater than the height of first pillow 441, second pillow 443, third pillow 445, fourth pillow 447, and/or fifth pillow 449. While the second section is exemplified with the plurality of pillows having five pillows, this disclosure contemplates greater or fewer numbers of pillows.

Each pillow may be coupled to the next adjacent pillow along corresponding common edges. While common edges in FIG. 4 are exemplified at an approximate midpoint along the height of the pillows, this disclosure contemplates common edges located at the bottom corners, top corners, middle, and at other locations along the height of the pillows.

FIG. 5 illustrates a side view of a pillow 500 having a plurality of sections configured to encapsulate a user's foot. A first section may include a single pillow 511. A second section may include a plurality of pillows (e.g., first pillow 541, second pillow 543, third pillow 545, fourth pillow 547, and fifth pillow 549). A third section may include a single pillow 551. Each section may be arranged numerically by section.

Pillow 511 and pillow 551 may have a length extending in the longitudinal direction and a height extending orthogonally to the longitudinal direction. The plurality of pillows of the second section may be different to pillow 511 and/or pillow 551. First pillow 541, second pillow 543, third pillow 545, fourth pillow 547, and fifth pillow 549 may each have a length extending in the longitudinal direction and a height extending orthogonally to the longitudinal direction. The height of pillow 511 may be equal to the height of pillow 551. The height of pillow 511 may be less than the height of first pillow 541, second pillow 543, third pillow 545, fourth pillow 547, and/or fifth pillow 549. The height of each of the plurality of pillows may be similar or different. The height of first pillow 541 may be less than the height of second pillow 543. The height of second pillow 543 may be less than the height of third pillow 545. The height of third pillow 545 may be greater than the height of fourth pillow 547. The height of fourth pillow 547 may be greater than the height of fifth pillow 549. The height of fifth pillow 549 may be greater than the height of pillow 511 and/or pillow 551.

This disclosure contemplates other combinations of pillow heights across all three sections. Pillow 511 may be relatively thick (e.g., of greater height) and pillow 551 may be relatively thin (e.g., of lesser height). The plurality of pillows of the second section may increase in height from relatively thin to relatively thick sequentially as they pass from pillow 511 to pillow 551. A person of ordinary skill in the art will appreciate that various combinations of pillows within the first, second, and third sections may optimize performance of pillow 500.

Figure 6:
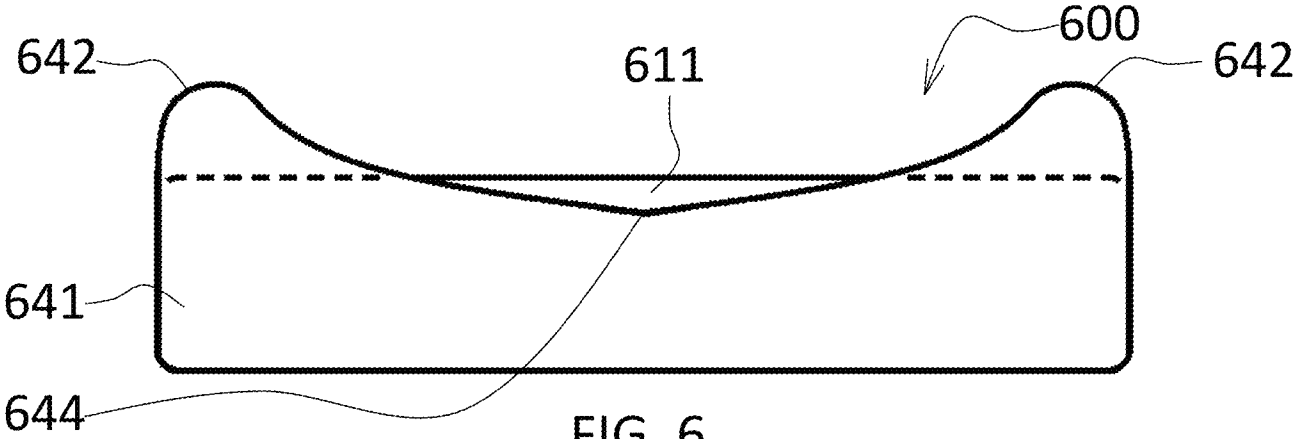
FIG. 6 illustrates a side view of a pillow.

FIG. 6 illustrates a side view of a pillow 600 having a plurality of sections configured to surround a user's foot. Previous descriptions of pillows may have assumed dimensions extending uniformly across the width dimension of the pillow, however, this disclosure contemplates non-uniform dimensions across the width dimension of the pillow (e.g., FIG. 6 may view the pillow with the longitudinal direction extending into and out of the page, such that adjoining sections may be exemplified as stacked in front of, or behind each other, which may be represented by stipled lines). Pillow 600 may include three or more sections as presented in this disclosure.

A section may include a first pillow 611. Another section may include at least a second pillow 641. In this description, first pillow 611 may be positioned behind second pillow 641 (e.g., with stipled lines indicating a dimension of first pillow 611). First pillow 611 may be relatively uniform in dimension, shape, and/or construction, as presented in this disclosure. Second pillow 641 may be formed with crests 642 and/or troughs 644 along one or more dimension (e.g., along a width dimension). Second pillow 641 may extend from a crest 642 at one side of its dimension to a crest 642 at an opposing side of its dimension. Second pillow 641 may have a trough 644 at an approximate midpoint of its dimension.

This disclosure contemplates crests 642 and troughs 644 at other positions along the dimension. This disclosure contemplates greater or fewer numbers of crests 642 and troughs 644 (e.g., 1, 2, 3, 4, 5, or more crests and/or troughs). The composition of crests and troughs may accommodate a user's foot (or feet) when the foot is contained within the folded pillow.

A user's foot may be placed on first pillow 611 (e.g., where first pillow 611 represents a pillow of the first section). At least the second pillow 641 may be folded up against the user's foot. The user's foot may be cradled within the trough 644 and/or between crests 642 (e.g., holding the user's foot in place, or providing support to the user's foot). As in previous descriptions, second pillow 641 may be one of a plurality of pillows which fold up around and/or over the user's foot to retain and/or support the user's foot. Crests 642 may further enclose the user's foot to insulate the foot against adverse temperatures.

A user's foot may be placed on second pillow 641 (e.g., where second pillow 641 represents a pillow of the first section). At least the first pillow 611 may be folded up against the user's foot. The user's foot may be cradled within the trough 644 and/or between crests 642 (e.g., holding the user's foot in place, or providing support to the user's foot). As in previous descriptions, first pillow 611 may be one of a plurality of pillows which fold up around and/or over the user's foot to retain and/or support the user's foot. Crests 642 may further enclose the user's foot to insulate the foot against adverse temperatures.

Figure 7:
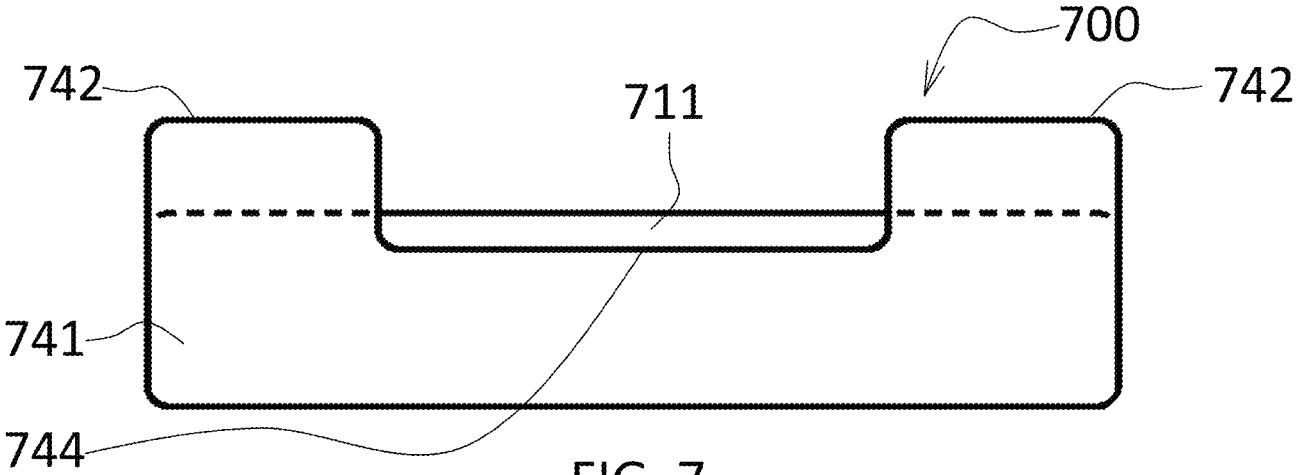
FIG. 7 illustrates a side view of a pillow.

FIG. 7 illustrates a side view of a pillow 700 having a plurality of sections configured to surround a user's foot. Previous descriptions of pillows may have assumed dimensions extending uniformly across a dimension of the pillow, however, this disclosure contemplates non-uniform dimensions across a dimension of the pillow. Adjoining sections may be exemplified as stacked in front of, or behind each other (e.g., with stipled lines). Pillow 700 may include three or more sections as presented in this disclosure.

A section may include a first pillow 711. Another section may include at least a second pillow 741. In this description, first pillow 711 may be positioned behind second pillow 741 (e.g., with stipled lines indicating a dimension of first pillow 711). As in the previous description, second pillow 741 may be formed with crests 742 and/or troughs 744 along one or more dimension (e.g., along a width dimension) to provide optimized support for a user's foot. Likewise, a user's foot may be placed on either first pillow 711 or second pillow 741 with the remaining pillows being folded up against, or over the user's foot as described in this disclosure.

In FIG. 7, the crests 742 and troughs 744 may be relatively abrupt (e.g., having rapid and/or sudden changes in the height and/or thickness of second pillow 741 along its dimension), whereas the crests 642 and troughs 644 of FIG. 6 may be relatively gradual. Abrupt contours and gradual contours may provide for different modes of support for the user's foot depending on what is needed for medical treatment.

First pillow 711 is exemplified as having a greater height and/or thickness than the height and/or thickness of second pillow 741 at trough 744, and a lesser height and/or thickness than the height and/or thickness of second pillow 741 at crests 742. This disclosure contemplates other arrangements. First pillow 711 may be less in dimension than a dimension at trough 744. First pillow 711 may be greater in dimension than a dimension at crests 742. First pillow 711 may be equal in dimension to trough 744. First pillow 711 may be equal in dimension to crests 742.

Other aspects will be apparent to those skilled in the art from consideration of the specification and practice disclosed herein. It is intended, therefore, that the specification and illustrated figures be considered as examples only.

What is claimed is:

1. A pillow, comprising:

a first section formed by a pillow;

a second section formed by a plurality of pillows; and a third section formed by a pillow, wherein the first, second, and third sections extend along a longitudinal direction, wherein a largest dimension of the plurality of pillows extends orthogonally to the longitudinal direction, and wherein the third section is capable of folding over the first section to form a cavity between the first, second, and third sections for enclosing around a user's foot, wherein the second section is coupled to the first section, and wherein the third section is coupled to the second section opposite the first section.

2. The pillow of claim 1, wherein the plurality of pillows includes five pillows.

3. The pillow of claim 1, wherein the pillows have a length dimension extending in the longitudinal direction, a width dimension extending orthogonally to the longitudinal direction, and a height dimension extending orthogonally to the length and width dimensions.

4. The pillow of claim 3, wherein the plurality of pillows each have a smaller length dimension than the pillows of the first and third sections.

5. The pillow of claim 3, wherein the plurality of pillows each have a smaller height dimension than the pillows of the first and third sections.

6. The pillow of claim 3, wherein some of the plurality of pillows have smaller height dimensions than others of the plurality of pillows.

7. A pillow, comprising:

a first section formed by a pillow;

a second section coupled to the first section, the second section formed by a plurality of pillows coupled together; and a third section coupled to the second section opposite the first section along a longitudinal direction, the third section formed by a pillow, wherein a largest dimension of the plurality of pillows extends orthogonally to the longitudinal direction, and wherein the third section is capable of folding over the first section to form a cavity between the first, second, and third sections for enclosing around a user's foot, wherein the second section is coupled to the first section, and wherein the third section is coupled to the second section opposite the first section.

8. The pillow of claim 7, wherein the pillows have a length dimension extending in the longitudinal direction, a width dimension extending orthogonally to the longitudinal direction, and a height dimension extending orthogonally to the length and width dimensions.

9. The pillow of claim 8, wherein the plurality of pillows each have a smaller length dimension than the pillows of the first and third sections.

10. The pillow of claim 8, wherein the plurality of pillows each have a larger height dimension than the pillows of the first and third sections.

11. The pillow of claim 8, wherein at least one of the plurality of pillows has one or more crests and one or more troughs along the width dimension.

12. The pillow of claim 11, wherein at least one of the one or more crests has a larger height dimension than the pillows of the first and third sections.

13. A method of folding a pillow around a foot of a patient, the pillow having a first section formed by a pillow, a second section formed by a plurality of pillows, and a third section formed by a pillow, wherein the first, second, and third sections extend sequentially in a longitudinal direction, and wherein a largest dimension of the plurality of pillows extends orthogonally to the longitudinal direction, the method comprising:

placing the foot on the first section;

folding the second section and third section until the third section is located above the first section; and enclosing the foot between the first, second, and third sections by sealing the first and third sections around a leg of the patient, wherein the second section is coupled to the first section, and wherein the third section is coupled to the second section opposite the first section.

14. The method of claim 13, wherein the pillows have a length dimension extending in the longitudinal direction, a width dimension extending orthogonally to the longitudinal direction, and a height dimension extending orthogonally to the length and width dimensions.

15. The method of claim 14, wherein the plurality of pillows each have an equal height dimension to the pillows of the first and third sections.

16. The method of claim 14, wherein the plurality of pillows each have an equal width dimension to the pillows of the first and third sections.

17. The method of claim 14, wherein at least one of the plurality of pillows has one or more crests and one or more troughs along the width dimension.

18. The method of claim 17, wherein at least one of the one or more crests has a larger height dimension than the pillows of the first and third sections.

* * * * *